US007620343B2

(12) United States Patent
Miyaji et al.

(10) Patent No.: US 7,620,343 B2
(45) Date of Patent: Nov. 17, 2009

(54) IMAGE FORMING APPARATUS AND METHOD HAVING CLEANER USING TITANIUM OXIDE PARTICLES

(75) Inventors: Shinki Miyaji, Osaka (JP); Nobuyuki Hayashi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/185,149

(22) Filed: Aug. 4, 2008

(65) Prior Publication Data

US 2009/0052934 A1 Feb. 26, 2009

(30) Foreign Application Priority Data

Aug. 23, 2007 (JP) ..... 2007-217522

(51) Int. Cl.
*G03G 15/00* (2006.01)
*G03G 21/00* (2006.01)

(52) U.S. Cl. ..... 399/96; 399/347

(58) Field of Classification Search ..... 399/46, 399/96, 159, 347, 349, 357; 430/108.6, 119.81
See application file for complete search history.

(56) References Cited

U.S. PATENT DOCUMENTS 6,480,695 B2 * 11/2002 Endo et al. ..... 399/349
7,272,344 B2 * 9/2007 Miura et al. ..... 399/159
7,272,354 B2 * 9/2007 Murakami et al. ..... 399/347
7,280,785 B2 * 10/2007 Kawada et al. ..... 399/159
7,482,106 B2 * 1/2009 Yoshizawa et al. ..... 430/119.71

FOREIGN PATENT DOCUMENTS

JP 3330009 9/2002
JP 2004245948 A * 9/2004
JP 2005017524 A * 1/2005

* cited by examiner

*Primary Examiner*—Robert Beatty
(74) *Attorney, Agent, or Firm*—Gerald E. Hespos; Anthony J. Casella

(57) ABSTRACT

The present invention provides an image forming apparatus and an image forming method capable of effectively suppressing the occurrence of image deletion etc. and thus stably obtaining a high-quality image and stably reducing the influence of titanium oxide particles on image quality. The image forming apparatus includes an amorphous silicon photoconductor drum having a heater provided therein; a charging device; and a rotating member that cleans the surfaces of the amorphous silicon photoconductor drum using titanium oxide particles included in toner particles. In the image forming apparatus and the image forming method using the same, the heater controls a difference between the surface temperature of the amorphous silicon photoconductor drum and the outdoor temperature within a predetermined range, and slide friction between the amorphous silicon photoconductor drum and the rotating member and the average primary particle diameter of the titanium oxide particles are set in predetermined ranges.

7 Claims, 6 Drawing Sheets

IMAGE FORMING APPARATUS AND METHOD HAVING CLEANER USING TITANIUM OXIDE PARTICLES

BACKGROUND OF THE INVENTION

1. Field of the Invention

The present invention relates to an image forming apparatus and an image forming method. Particularly, the present invention relates to an image forming apparatus capable of effectively suppressing the occurrence of image deletion and color muddiness and stably obtaining a high-quality image and to an image forming method using the same.

2. Description of the Related Art

Conventionally, amorphous silicon photoconductors have come into widespread use since they have high surface hardness and high durability and are easy to treat.

Meanwhile, in the amorphous silicon photoconductor, a discharge product generated during a charging process is likely to be adhered to the surface of a photosensitive layer, and the discharge product adhered to the surface of the photosensitive layer readily absorbs water. As a result, the amorphous silicon photoconductor is likely to generate image deletion.

In order to solve these problems, a method in which a heater is provided in an amorphous silicon photoconductor drum has been proposed.

That is, according to this method, water absorbed by the discharge product that is adhered to the surface of a photosensitive layer is evaporated by heat generated by the heater, thereby suppressing the occurrence of image deletion.

However, in the above-mentioned method, since the amount of discharge product adhered to the surface of the photosensitive layer continuously increases, it is difficult to stably remove water from the surface of the photosensitive layer. As a result, it is difficult to effectively suppress the occurrence of image deletion.

As another method of suppressing the occurrence of the image deletion, a method has been proposed which polishes the surface of an amorphous silicon photoconductor using titanium oxide particles that are added to a developer as an additive, thereby certainly removing a discharge product from the surface of the amorphous silicon photoconductor (for example, see Patent Document 1).

However, when the method disclosed in Patent Document 1 is used, it is possible to reliably suppress the occurrence of the image deletion. However, in this case, some of the titanium oxide particles are developed together with toner particles. Therefore, in particular, when a color image is formed, color muddiness occurs in the formed color image. As a result, it is difficult to obtain a high-quality image.

Accordingly, an image forming apparatus is needed which is capable of effectively suppressing the occurrence of the image deletion and the occurrence of color muddiness and stably obtaining a high-quality image, even when an amorphous silicon photoconductor is used as an electrophotographic photoconductor.

The inventors found that it was possible to effectively remove the discharge product adhered to the surface of the photosensitive layer and water absorbed by the discharge product and reduce the influence of the titanium oxide particles on image quality by using both the amorphous silicon photoconductor drum having the heater provided therein and the rotating member that polishes the surface of the amorphous silicon photoconductor drum using the titanium oxide particles, and setting a difference between the surface temperature of the amorphous silicon photoconductor drum and the outdoor temperature, the slide friction between the amorphous silicon photoconductor drum and the rotating member, and the average primary particle diameter of the titanium oxide particles in predetermined ranges. The present invention has been made on the basis of the findings.

SUMMARY OF THE PRESENT INVENTION

Accordingly, an object of the present invention is to provide an image forming apparatus and an image forming method using the same capable of effectively suppressing the occurrence of image deletion and the occurrence of color muddiness and thus stably obtaining a high-quality image by effectively removing a discharge product adhered to the surface of a photosensitive layer and water absorbed by the discharge product and reducing the influence of titanium oxide particles on image quality.

In order to achieve the above-mentioned object, according to the present invention, an image forming apparatus includes: an amorphous silicon photoconductor drum having a heater provided therein; a charging device; and a rotating member that cleans the surfaces of the amorphous silicon photoconductor drum using titanium oxide particles included in toner particles. The heater is controlled such that the surface temperature of the amorphous silicon photoconductor drum is higher by 4° C. or more than the outdoor temperature, which is in a range of 10 to 40° C. The slide friction between the amorphous silicon photoconductor drum and the rotating member is set in a range of 40 to 900 gf/cm, and the average primary particle diameter of the titanium oxide particles is set in a range of 0.005 to 0.25 μm.

That is, it is possible to effectively remove the discharge product adhered to the surface of the photosensitive layer and water absorbed by the discharge product and reduce the influence of the titanium oxide particles on image quality by using both the amorphous silicon photoconductor drum having the heater provided therein and the rotating member that polishes the surface of the amorphous silicon photoconductor drum using the titanium oxide particles, and performing a temperature control process using the heater and a cleaning process using the rotating member under predetermined conditions.

More specifically, the heater is used to remove water absorbed on the surface of the photosensitive layer and the rotating member is used to remove the discharge product adhered to the surface of the photosensitive layer. Therefore, it is possible to reduce the cleaning strength (polishing strength) of the rotating member to a predetermined range while reducing the occurrence of image deletion to a certain level.

Therefore, it is possible to effectively suppress the occurrence of the image deletion and stably suppress the occurrence of color muddiness in a formed image due to the influence of the titanium oxide particles, even though the slide friction and the average primary particle diameter of the titanium oxide particle are set in relatively small ranges.

Further, since the slide friction is set in a relatively small range, it is possible to obtain appropriate slide friction between the rotating member and the photoconductor drum. When the appropriate slide friction is not obtained, that is, when the rotating member is caught in the photoconductor drum, a line (hereinafter, in some cases, referred to as jitter) is generated in a formed image in the axial direction of the photoconductor drum. However, when the slide friction is set within the above-mentioned range, it is possible to effectively suppress the generation of jitter.

In the image forming apparatus according to the present invention, preferably, 0.1 to 5 parts by weight of titanium oxide particles are added with respect to 100 parts by weight of toner particles.

According to the above-mentioned structure, it is possible to effectively remove the discharge product adhered to the surface of the photosensitive layer and stably suppress the occurrence of color muddiness in a formed image.

In the image forming apparatus according to the present invention, preferably, the rotating member has an elastic layer in its outer circumferential portion.

According to the above-mentioned structure, it is possible to effectively polish the surface of the photosensitive layer using the titanium oxide particles.

In the image forming apparatus according to the present invention, preferably, the rotating member having the elastic layer is a foam sponge roller.

According to the above-mentioned structure, it is possible to more effectively attract and transport the titanium oxide particles. As a result, it is possible to more effectively polish the surface of the photosensitive layer using the titanium oxide particles.

In the image forming apparatus according to the present invention, preferably, the charging device is a non-contact type.

When the non-contact type charging device is used, the amount of discharge product adhered to the surface of the photosensitive layer increases, as compared to when a contact type charging device is used. However, according to the present invention, it is possible to effectively suppress the occurrence of image deletion due to the discharge product.

In the image forming apparatus according to the present invention, preferably, the image forming apparatus is a color image forming apparatus.

When a color image forming apparatus is used, color muddiness increases due to the influence of the titanium oxide particles, as compared to a monochrome image forming apparatus. However, according to the present invention, it is possible to reduce the influence of the titanium oxide particles on image quality and thus stably suppress the occurrence of color muddiness.

According to another aspect of the present invention, an image forming method includes: developing and transferring electrostatic latent images formed on an amorphous silicon photoconductor drum having a heater provided therein; and cleaning the surfaces of the amorphous silicon photoconductor drum using a rotating member and titanium oxide particles included in toner particles, after the images are transferred. In the method, the heater is controlled such that the surface temperature of the amorphous silicon photoconductor drum is higher by 4° C. or more than the outdoor temperature, which is in a range of 10 to 40° C. In addition, slide friction between the amorphous silicon photoconductor drum and the rotating member is set in a range of 40 to 900 g/cm, and the average primary particle diameter of the titanium oxide particles is set in a range of 0.005 to 0.25 μm.

That is, according to the present invention, it is possible to effectively suppress the occurrence of image deletion and stably suppress the occurrence of color muddiness in a formed image due to the influence of the titanium oxide particles by using both the amorphous silicon photoconductor drum having the heater provided therein and the rotating member that polishes the surface of the amorphous silicon photoconductor drum using the titanium oxide particles, and performing a temperature control process using the heater and a cleaning process using the rotating member under predetermined conditions.

DETAILED DESCRIPTION OF THE PREFERRED EMBODIMENT

First Embodiment

A first embodiment provides an image forming apparatus including: an amorphous silicon photoconductor drum having a heater provided therein; a charging device; and a rotating member that cleans the surfaces of the amorphous silicon photoconductor drum using titanium oxide particles included in toner particles. In the apparatus, the heater is controlled such that the surface temperature of the amorphous silicon photoconductor drum is higher by 4° C. or more than the outdoor temperature, which is in a range of 10 to 40° C. In addition, slide friction between the amorphous silicon photo conductor drum and the rotating member is set in a range of 40 to 900 g/cm, and the average primary particle diameter of the titanium oxide particles is set in a range of 0.005 to 0.25 μm.

Hereinafter, components of an image forming apparatus according to the first embodiment will be individually described, but the description will be focused on an image carrier, a cleaning device, and a charging device, which are characteristic components of the present invention.

1. Basic Structure

Figure 1:
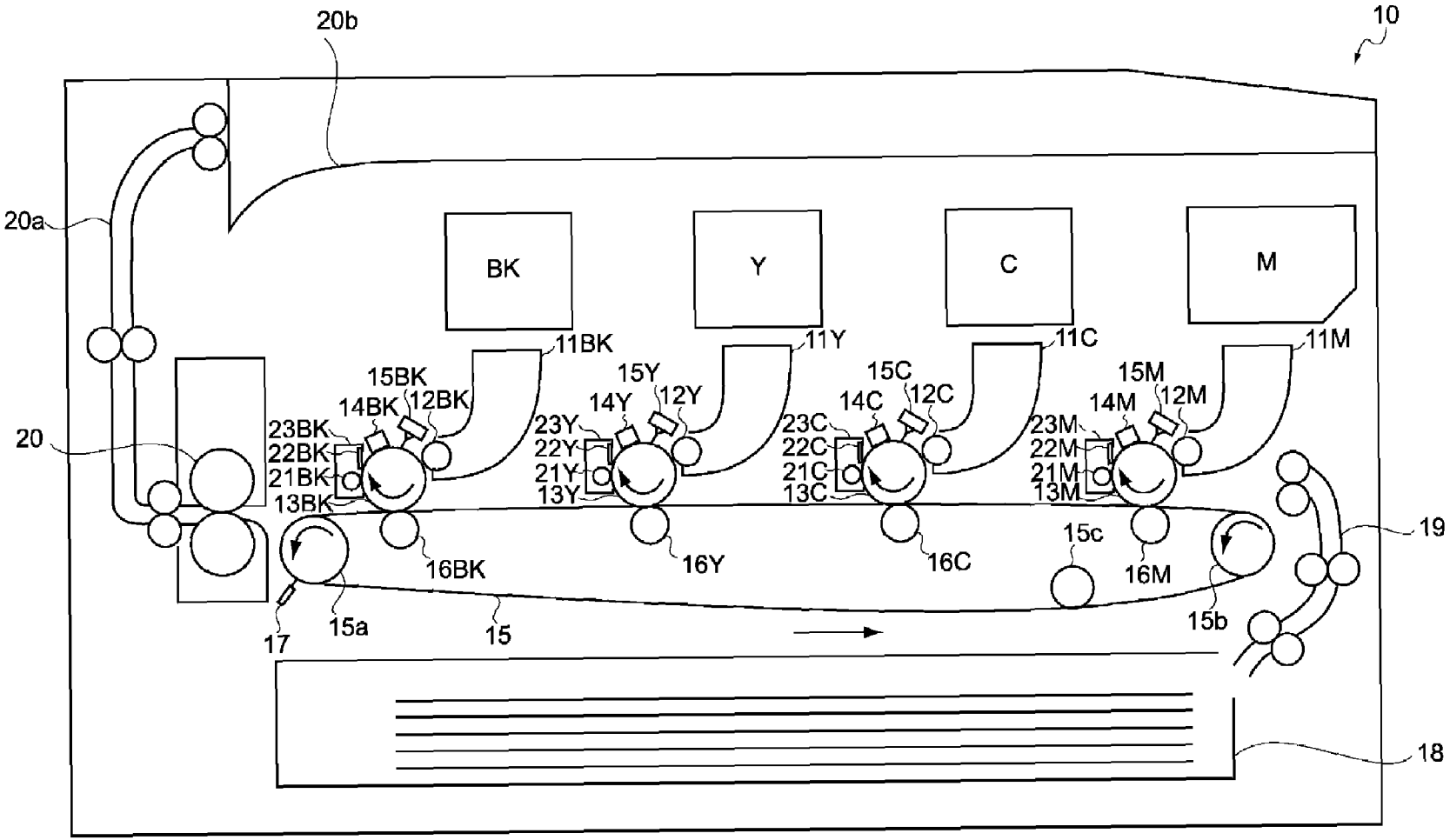
FIG. 1 is a diagram illustrating an image forming apparatus according to the present invention.

FIG. 1 is a diagram illustrating a tandem-type color image forming apparatus 10, which is an example of the image forming apparatus according to the present invention.

The color image forming apparatus 10 includes an endless belt (transport belt) 15, and the endless belt 15 is configured to transport a recording sheet that is fed from a paper feeding cassette 18 to a fixing device 20. In addition, a magenta developing device 11M, a cyan developing device 11C, a yellow developing device 11Y, and a black developing device 11BK are arranged above the endless belt 15 along a direction in which the recording sheet is transported.

Further, image carriers 13M to 13BK are arranged so as to face developing rollers 12M to 12BK, respectively. In addition, charging devices 14M to 14BK that charge the surfaces of the image carriers 13M to 13BK and exposure devices 15M to 15BK that form electrostatic latent images on the surfaces of the image carriers 13M to 13BK are arranged around the image carriers 13M to 13BK, respectively.

Therefore, the electrostatic latent images formed on the image carriers 13M to 13BK corresponding to the above each color are developed by the developing devices 11M to 11BK corresponding to the above each color.

Further, transfer devices 16M to 16BK that sequentially transfer color developer images on the recording sheet transported by the endless belt 15 are arranged so as to be respectively opposite to the image carriers 13M to 13BK with the endless belt 15 interposed therebetween.

Further, cleaning devices 23M to 23BK are arranged around the image carriers 13M to 13BK. The cleaning devices 23M to 23BK include cleaning blades 22M to 22BK that remove a non-transferred developer remaining on the image carriers 13M to 13BK after the color toner images are transferred, and rotating members 21M to 21BK that polish the surfaces of the image carriers 13M to 13BK using titanium oxide particles, respectively.

Meanwhile, in a color image forming apparatus, color muddiness increases due to the influence of the titanium oxide particles that are transported to the rotating members 21M to 21BK for cleaning, as compared to the monochrome image forming apparatus. However, according to the present invention, it is possible to reduce the influence of the titanium oxide particles and thus stably suppress the color muddiness.

2. Image Carrier

The present invention is characterized in that an amorphous silicon photoconductor drum is used as the image carrier.

The reason is that the amorphous silicon photo conductor drum has, for example, high surface hardness and high durability and is easy to treat, as compared to a selenium-based photoconductor drum or an organic photoconductor drum.

That is, since the amorphous silicon photoconductor drum has high surface hardness, a photosensitive layer is not easily worn and scratches or pressure welding marks are less likely to be generated on the surface of the photosensitive layer, even when image forming is repeatedly performed. In addition, the amorphous silicon photoconductor drum can be easily incorporated into the image forming apparatus.

Figure 2:
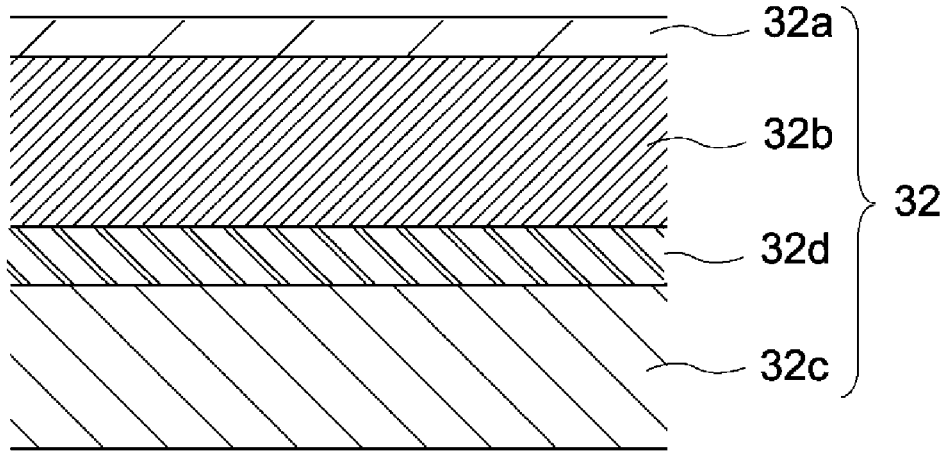
FIG. 2 is a diagram illustrating an amorphous silicon photoconductor drum according to the present invention.

As shown in FIG. 2, basically, it is preferable to form a photosensitive layer 32 of the amorphous silicon photoconductor drum by sequentially laminating, on a conductive base body 32*c*, a carrier injection suppressing layer 32*d* made of, for example, Si:H:B:O, a carrier excitation and transport layer (photoconductor layer) 32*b* made of, for example, Si:H, and a surface protecting layer 32*a* made of, for example, SiC:H.

Furthermore, the present invention is characterized in that the amorphous silicon photoconductor drum includes a heater.

The reason is as follows. Since the amorphous silicon photoconductor drum has high surface hardness, a discharge product, such as nitric acid ions or ammonium ions generated during a charging process, is likely to be adhered to or remain on the surface of the photosensitive layer. In addition, since the generated discharge product readily absorbs water, the resistance of the surface of the photoconductor to which the discharge product is adhered is lowered, and the edge of the electrostatic latent image formed on the surface of the photosensitive layer causes a horizontal flow. As a result, an image flow, that is, so-called image deletion is more likely to occur. For this reason, the heater is provided in the amorphous silicon photoconductor drum to evaporate water remaining on the surface of the photosensitive layer, thereby suppressing the occurrence of the image deletion.

Figure 3:
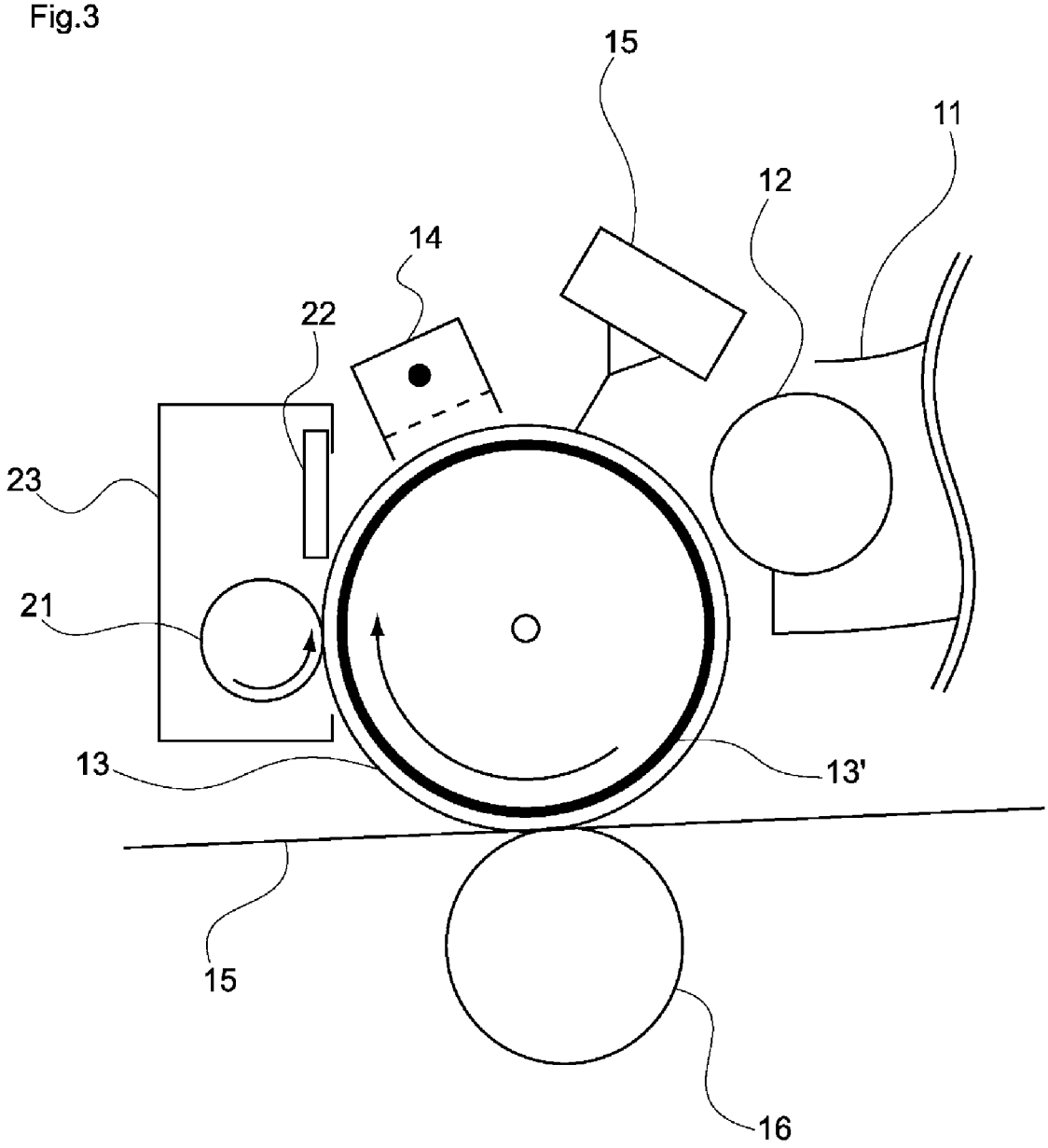
FIG. 3 is a diagram illustrating an image forming unit according to the present invention.

The heater will be described in detail below. As shown in FIG. 3, a heater 13' for heating a photoconductor is inserted into the base body of the amorphous silicon photoconductor drum 13, and is arranged so as to follow the inner surface of the base body.

In addition, for example, a sheet-shaped member having formed therein a linear object, which is obtained by covering the surface of glass cross having a wire heater provided therein with, for example, a urethane film, is preferably used as the heater 13'.

The operation of the heater 13' is associated with the on or off timing of a power supply of the image forming apparatus. The heater 13' is controlled such that the temperature thereof increases up to a target temperature and is then maintained, and the temperature is detected by a temperature detecting unit, such as a thermistor (not shown) provided in the amorphous silicon photoconductor drum 13.

Further, the present invention is characterized in that the heater is controlled such that the surface temperature of the amorphous silicon photoconductor drum is higher by 4° C. or more than the outdoor temperature, which is in a range of 10 to 40° C.

The reason is as follows. When the difference between the surface temperature of the amorphous silicon photoconductor drum and the outdoor temperature is less than 4° C., it may be difficult to sufficiently evaporate water on the surface of the photosensitive layer. On the other hand, when the difference between the surface temperature of the amorphous silicon photoconductor drum and the outdoor temperature is excessively large, it is uneconomic, and the internal temperature of the apparatus increases, which may have an adverse effect on the developing device or a developer.

Therefore, the difference between the surface temperature of the amorphous silicon photoconductor drum and the outdoor temperature is preferably in a range of 5 to 20° C., more preferably, 6 to 15° C.

The term "outdoor" means an environmental temperature at which the amorphous silicon photoconductor drum is used.

Therefore, this environment means the indoor environment of, for example, an office where the image forming apparatus is mainly used. It is preferable that the outdoor temperature be in the range of the indoor temperature of, for example, a general office, more specifically, in a range of 20 to 35° C.

However, even though the indoor temperature of, for example, an office is out of the range of 10 to 40° C., it is possible to satisfy the outdoor temperature conditions by appropriately adjusting the internal temperature of the image forming apparatus to a range of 10 to 40° C.

When only the heater is used to remove water from the surface of the photosensitive layer, the amount of discharge product generated on the surface of the photosensitive layer increases. Therefore, it is difficult to stably remove water from the surface of the photosensitive layer in the long term. As a result, it is difficult to effectively suppress the occurrence of the image deletion.

Therefore, in order to solve the above problems, the present invention adopts a method of using both a rotating member and titanium oxide particles to remove a discharge product from the surface of the photosensitive layer, which will be described below.

Next, the relationship between the occurrence of the image deletion and the difference between the surface temperature of the amorphous silicon photoconductor drum and the outdoor temperature will be described with reference to FIG. 4.

Figure 4:
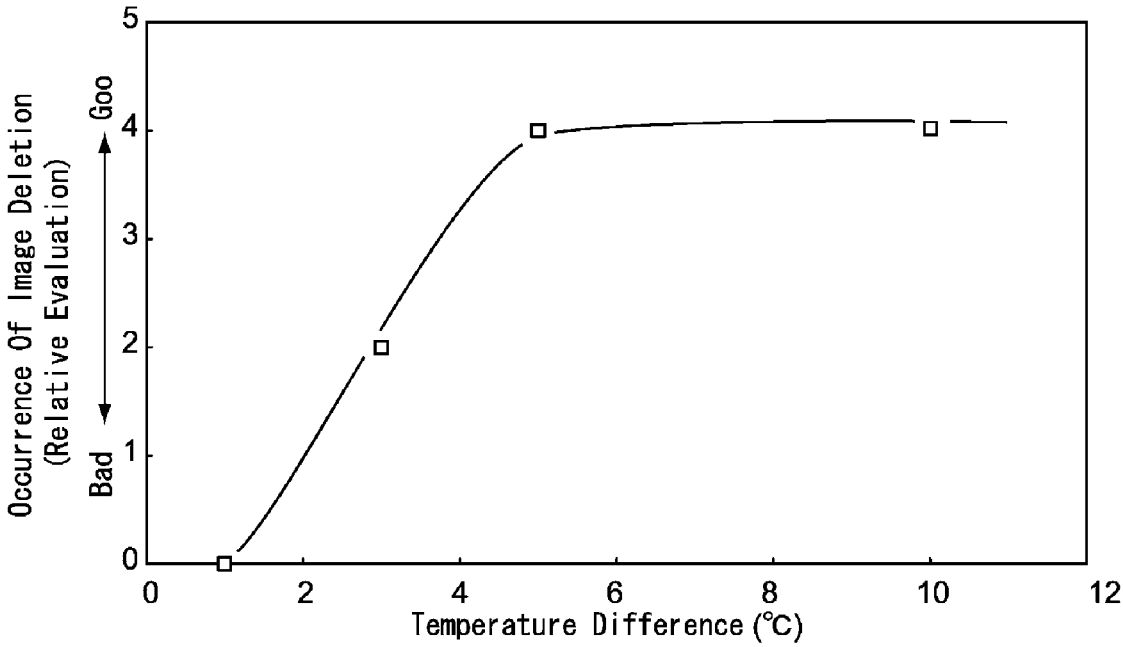
FIG. 4 is a diagram illustrating the relationship between a difference between the surface temperature of the amorphous silicon photoconductor drum and the outdoor temperature and the occurrence of image deletion.

That is, FIG. 4 shows that a characteristic curve wherein the difference (° C.) between the surface temperature of the amorphous silicon photoconductor drum and the outdoor temperature is taken on an axis of abscissas and the occurrence (relative evaluation) of the image deletion during an image forming process is taken on an axis of ordinates.

During the image forming process, slide friction between the amorphous silicon photoconductor drum and the rotating member is set to 50 g/cm and the average primary particle diameter of the titanium oxide particles is set to 0.01 μm.

The other image forming conditions will be described in the subsequent Examples.

In the relative evaluation of the occurrence of the image deletion in a formed image, the formed image is examined by eyes, and the examined result is graded according to the following standards:

evaluation value 4: no image deletion occurs;

evaluation value 2: a little image deletion occurs; and evaluation value 0: image deletion certainly occurs.

That is, as can be seen from the characteristic curve, as the difference between the surface temperature of the amorphous silicon photoconductor drum and the outdoor temperature (hereinafter, referred to as a temperature difference) increases, the relative evaluation value of the occurrence of the image deletion increases.

More specifically, it can be seen that, as the temperature difference increases from 0° C. to 5° C., the relative evaluation value of the occurrence of the image deletion sharply increases from 0 to 4. When the temperature difference is above by 4° C., the relative evaluation value of the occurrence of the image deletion is stably maintained in a range of 3 or more.

Therefore, when the surface of the amorphous silicon photoconductor drum is polished under predetermined conditions, it is possible to critically suppress the occurrence of the image deletion by controlling the surface temperature of the amorphous silicon photoconductor drum to be higher by 4° C. or more than the outdoor temperature, which is in a predetermined temperature range.

3. Cleaning Device (1) Rotating Member

The present invention is characterized in that a cleaning device includes a rotating member that transports titanium oxide particles while attracting the titanium oxide particles in order to polish the surface of the photosensitive layer.

The reason is as follows. The cleaning device polishes and removes the discharge product adhered to the surface of the photosensitive layer, while attracting and transporting the titanium oxide particles, which is an additive included in non-transferred toner that is collected from the surface of the photosensitive layer, using the rotating member. In this way, it is possible to suppress the occurrence of the image deletion.

The titanium oxide particles that are attracted and transported by the rotating member are generally isolated from toner particles. However, the titanium oxide particles may be attracted and transported by the rotating member together with the toner particles, without being isolated from the toner particles.

Further, it is preferable that the rotating member has an elastic layer in its outer circumferential portion.

The reason is that, when the rotating member includes the elastic layer in its outer circumferential portion, it is possible to more effectively polish the surface of the photosensitive layer using the titanium oxide particles.

That is, when a rotating member 21 shown in FIG. 3 is used as the rotating member, the rotating member 21 can effectively attract and transport non-transferred toner collected by the cleaning device 23, and thus it is possible to effectively polish the surface of the photosensitive layer using the titanium oxide particles, which are an additive included in the non-transferred toners.

Further, it is possible to easily adjust cleaning strength by adjusting the ratio of the peripheral speed of the rotating member 21 and the peripheral speed of the amorphous silicon photoconductor drum 13.

Furthermore, the rotating member having the elastic layer in its outer circumferential portion makes it possible to effectively attract and transport the titanium oxide particles and easily adjust the slide friction against the surface of the photosensitive layer.

It is preferable that the rotating member including the elastic layer be a foam sponge roller.

The reason is as follows. When the rotating member including the elastic layer is formed of a foam sponge roller, it is possible to effectively attract and transport the titanium oxide particles, and thus more effectively polish the surface of the photosensitive layer using the titanium oxide particles.

Preferably, the foam sponge may be mainly formed of, for example, ethylene-propylene-diene rubber, ethylene-propylene rubber, urethane rubber, silicon rubber, acryl rubber, and nitrile rubber.

In order to easily attract and transport the titanium oxide particles, the average cell diameter of the form sponge is preferably set in a range of 100 to 300 μm, more preferably, in a range of 140 to 260 μm.

Furthermore, in order to easily adjust the slide friction against the surface of the photosensitive layer, the Asker C hardness of the foam sponge roller is preferably set in a range of 30 to 65, more preferably, 45 to 55.

(2) Titanium Oxide Particle

The present invention is characterized in that the average primary particle diameter (the number average particle diameter) of the titanium oxide particles is set in a range of 0.005 to 0.25 μm.

The reason is as follows. When the average primary particle diameter of the titanium oxide particles is in the above-mentioned range, it is possible to ensure predetermined cleaning strength, and thus stably suppress the occurrence of color muddiness in a formed image due to the influence of the titanium oxide particles, while effectively removing the discharge product adhered to the surface of the photosensitive layer.

That is, the present invention uses both the amorphous silicon photoconductor drum having the heater provided therein and the rotating member that polishes the surface of the amorphous silicon photoconductor drum using the titanium oxide particles. Therefore, it is possible to reduce the occurrence of the image deletion to a predetermined level and lower the cleaning strength of the rotating member to a predetermined level.

As a result, it is possible to effectively suppress the occurrence of the image deletion even though the average primary particle diameter of the titanium oxide particle is set in a relatively small range of 0.005 to 0.25 μm.

Further, it is possible to stably suppress the occurrence of color muddiness in a formed image due to the influence of the titanium oxide particles by setting the average primary particle diameter of the titanium oxide particles in a relatively small range.

Therefore, in order to improve the balance between cleaning strength required to remove the discharge product from the surface of the photosensitive layer by cleaning and the suppression of color muddiness in a formed image, the average primary particle diameter of the titanium oxide particles is preferably set in a range of 0.01 to 0.2 μm, more preferably, 0.02 to 0.15 μm.

In addition, the average primary particle diameter of the titanium oxide particles can be calculated by measuring the major axis and the minor axis of each of 50 particles using, for example, an electron microscope JSM-880 (manufactured by JEOL DATUM, LTD.) with a magnification of 30,000 to 100,000 and averaging the measured values.

Next, the relationship between the average primary particle diameter of the titanium oxide particles, the occurrence of color muddiness in a formed image, and the occurrence of image deletion will be described with reference to FIG. 5.

Figure 5:
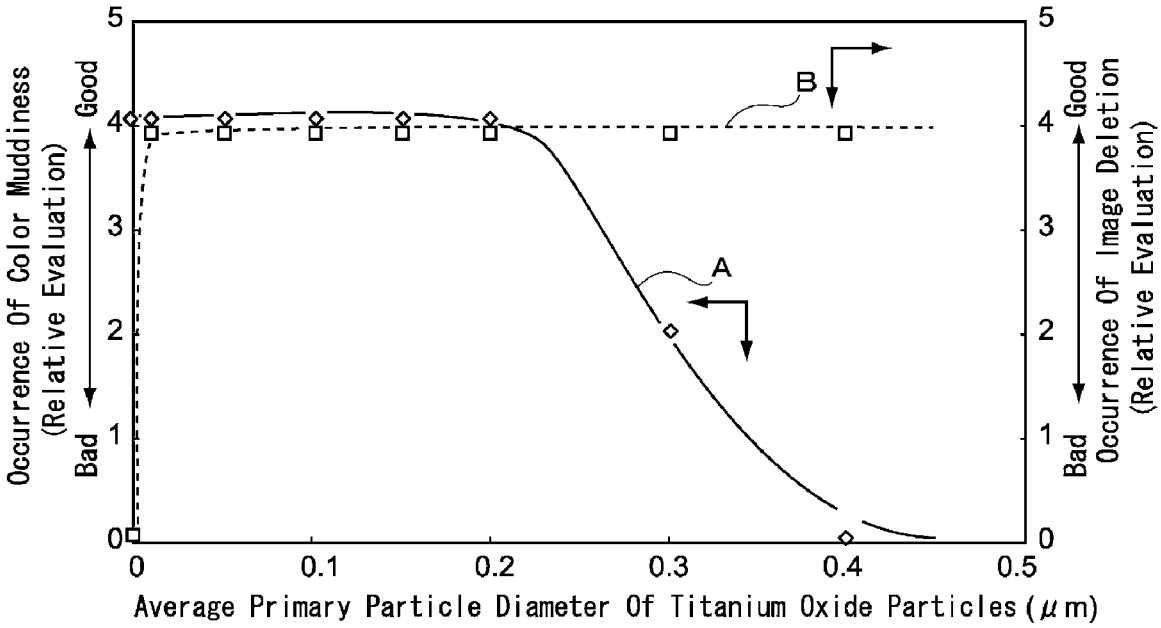
FIG. 5 is a diagram illustrating the relationship among the average primary particle diameter of titanium oxide particles, the occurrence of color muddiness, and the occurrence of image deletion.

That is, in FIG. 5, the average primary particle diameter (μm) of the titanium oxide particles is taken on an axis of abscissas, a characteristic curve A representing the occurrence (relative evaluation) of color muddiness in a formed image is taken on a left axis of ordinates, and a characteristic curve B representing the occurrence (relative evaluation) of image deletion in a formed image is taken a right axis of ordinates.

During an image forming process, the difference between the surface temperature of the amorphous silicon photoconductor drum and the outdoor temperature is set to 5° C. and slide friction between the amorphous silicon photoconductor drum and the rotating member is set to 50 g/cm.

The other image forming conditions will be described in the subsequent Examples.

In the relative evaluation of the occurrence of color muddiness in a formed image, 100 image patterns each having a solid patch (a square of 2 cm×2 cm) formed thereon are printed, the obtained 100 image patterns are examined by a microscope, and the examined results are graded according to the following standards:

evaluation value 4: no color muddiness occurs in the 100 color and black images;

evaluation value 2: a little color muddiness occurs in the 100 color or black images; and evaluation value 0: color muddiness certainly occurs in the 100 color or black images.

The evaluation of the image deletion is the same as that shown in FIG. 4.

That is, as can be seen from the characteristic curve A, as the average primary particle diameter of the titanium oxide particles increases, the relative evaluation value of the occurrence of the color muddiness decreases.

More specifically, when the average primary particle diameter of the titanium oxide particles is in a range of 0 μm (that is, no titanium oxide particle is added) to 0.25 μm, the relative evaluation value of the occurrence of the color muddiness is stably maintained in a range of 3 or more, regardless of the average primary particle diameter of the titanium oxide particles. On the other hand, when the average primary particle diameter of the titanium oxide particles is larger than 0.25 μm, the relative evaluation value of the occurrence of the color muddiness rapidly starts decreasing as the average primary particle diameter of the titanium oxide particles increases. When the average primary particle diameter of the titanium oxide particles is 0.4 μm, the relative evaluation value of the occurrence of the color muddiness is reduced to 0.

Further, as can be seen from the characteristic curve B, as the average primary particle diameter of the titanium oxide particles increases, the relative evaluation value of the occurrence of image deletion increases.

More specifically, when the average primary particle diameter of the titanium oxide particles increases from 0 μm to 0.01 μm, the relative evaluation value of the occurrence of the image deletion sharply increases from 0 to 4. When the average primary particle diameter of the titanium oxide particles is 0.005 μm or more, the relative evaluation value of the occurrence of the image deletion is stably maintained in a range of 3 or more.

Therefore, as can be seen from both the characteristic curves A and B, when the difference between the surface temperature of the amorphous silicon photoconductor drum and the outdoor temperature and the slide friction between the amorphous silicon photoconductor drum and the rotating member are set in predetermined ranges, it is possible to suppress both the occurrence of the color muddiness in a formed image and the occurrence of the image deletion by setting the average primary particle diameter of the titanium oxide particles in a range of 0.005 to 0.25 μm.

Further, it is preferable that the titanium oxide particles have a rutile titanium oxide as a main component.

The reason is that the rutile titanium oxide can easily adjust the average primary particle diameter of the titanium oxide particles to a predetermined range.

(3) Slide Friction

The present invention is characterized in that the slide friction between the amorphous silicon photoconductor drum and the rotating member is set in a range of 40 to 900 g/cm.

The reason is as follows. When the slide friction between the amorphous silicon photoconductor drum and the rotating member is set in the above-mentioned range, it is possible to obtain appropriate slide friction between the rotating member and the photosensitive layer. When the appropriate slide friction is not obtained, that is, when the rotating member is caught in the photoconductor drum, a line is formed in the formed image in the axial direction of the photoconductor drum, that is, so-called jitter is generated. However, when the slide friction is within the above-mentioned range, it is possible to effectively suppress the generation of jitter.

That is, when the slide friction between the amorphous silicon photoconductor drum and the rotating member is less than 40 g/cm, the effect of removing a discharge product from the surface of the photosensitive layer is excessively deteriorated, which makes it difficult to suppress the generation of the image deletion. On the other hand, when the slide friction between the amorphous silicon photo conductor drum and the rotating member is above 900 g/cm, it may be difficult to effectively suppress the generation of jitter.

Therefore, the slide friction between the amorphous silicon photoconductor drum and the rotating member is preferably set in a range of 45 to 800 g/cm, more preferably, in a range of 50 to 700 g/cm.

Meanwhile, in the present invention, it is possible to effectively suppress the generation of the image deletion by using both the amorphous silicon photoconductor drum having a heater provided therein and the rotating member that polishes the surface of the amorphous silicon photoconductor drum using the titanium oxide particles, even though the slide friction is set in the range of 40 to 900 g/cm.

The slide friction is measured as follows.

That is, a PET film having a thickness of 100 μm is interposed between the rotating member and the amorphous silicon photoconductor drum, and a spring is provided in the PET film. Then, the amorphous silicon photoconductor drum is rotated and driven a tensile load is measured at that time. Finally, the obtained tensile load is divided by the width of the PET film, thereby calculating the slide friction.

Next, the relationship among the slide friction between the amorphous silicon photoconductor drum and the rotating member, the occurrence of image deletion in a formed image, and the generation of jitter in the formed image will be described with reference to FIG. 6.

Figure 6:
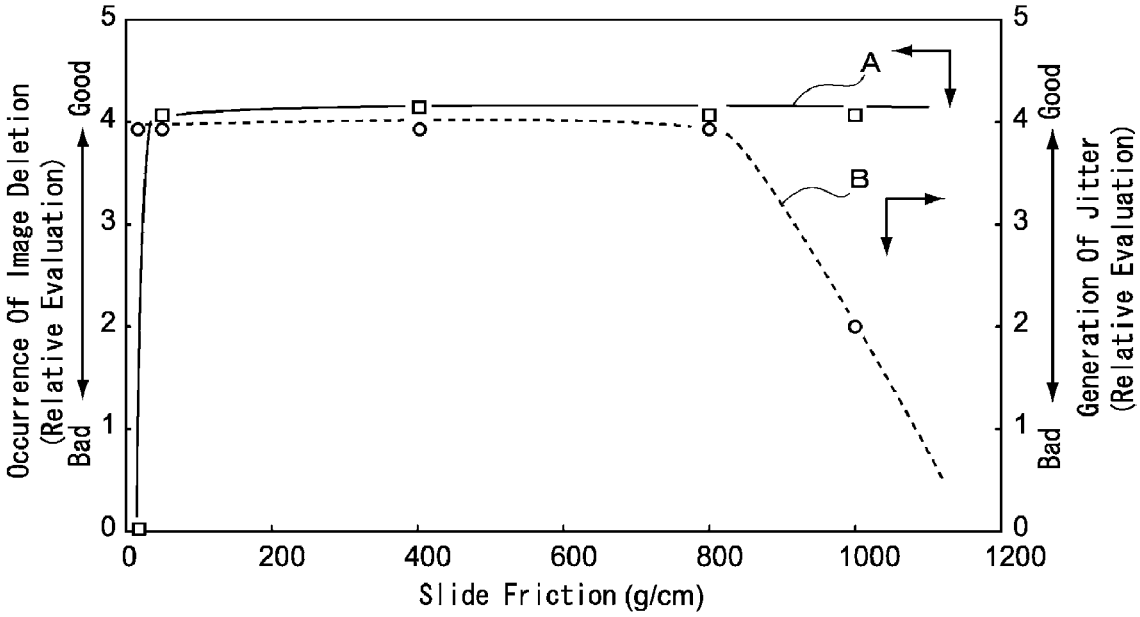
FIG. 6 is a diagram illustrating the relationship among slide friction between the amorphous silicon photoconductor drum and a rotating member, the occurrence of image deletion, and the generation of jitter.

That is, in FIG. 6, the slide friction (g/cm) between the amorphous silicon photoconductor drum and the rotating member is taken on an axis of abscissas, a characteristic curve A representing the occurrence (relative evaluation) of image deletion in a formed image is taken on a left axis of ordinates, and a characteristic curve B representing the generation (relative evaluation) of jitter in the formed image is taken on a right axis of ordinates.

During an image forming process, the difference between the surface temperature of the amorphous silicon photoconductor drum and the outdoor temperature is set to 5° C. and the average primary particle diameter of the titanium oxide particles is set to 0.2 μm.

The other image forming conditions will be described in the subsequent Examples.

In the relative evaluation of the generation of jitter in a formed image, 100 gray images are printed, the obtained 100 gray image are examined by eyes, and the examined results are graded according to the following standards:

- evaluation value 4: no jitter is generated from the 100 gray images;
- evaluation value 2: a little jitter is generated from the 100 gray images; and
- evaluation value 0: jitter is certainly generated from the 100 gray images.

The evaluation of the image deletion is the same as that shown in FIGS. 4 and 5.

That is, as can be seen form the characteristic curve A, as the slide friction between the amorphous silicon photoconductor drum and the rotating member (hereinafter, referred to as slide friction) increases, the relative evaluation value of the image deletion increases.

More specifically, as the slide friction increases from 0 g/cm to 50 g/cm, the relative evaluation value of the image deletion rapidly increases from 0 to 4. If the slide friction is 40 g/cm or more, the value of the occurrence of the image deletion can be stably maintained in a range of 3 or more.

Further, as can be seen form the characteristic curve B, as the slide friction increases, the relative evaluation value of the generation of jitter decreases.

More specifically, as the slide friction is in a range of 0 g/cm to 900 g/cm, the relative evaluation value of the generation of the jitter can be stably maintained in a range of 3 or more, regardless of a variation in the slide friction. If the slide friction is above 900 g/cm, the relative evaluation value of the generation of the jitter rapidly decreases as the slide friction increases. If the slide friction is 1200 g/cm, the relative evaluation value of the generation of the jitter is reduced to approximately zero.

Therefore, taking both the characteristic curves A and B into consideration, when the difference between the surface temperature of the amorphous silicon photoconductor drum and the outdoor temperature and the average primary particle diameter of the titanium oxide particles are set in predetermined ranges, it is possible to suppress both the occurrence of image deletion in a formed image and the generation of jitter in the image by setting the slide friction between the amorphous silicon photoconductor drum and the rotating member in a range of 40 g/cm to 900 g/cm.

4. Charging Device

In the present invention, a contact type charging device, such as a charging roller or a charging brush, can be used. However, it is preferable to use a non-contact type charging device such as a scorotron 14 shown in FIG. 3.

The reason is as follows. When the non-contact type charging device is used, the amount of discharge product adhered to the surface of the photosensitive layer increases, as compared to when the contact type charging device is used. However, according to the present invention, it is possible to effectively suppress the occurrence of image deletion due to the discharge product.

That is, according to the present invention, it is possible to effectively remove the discharge product adhered to the surface of the photosensitive layer and water absorbed by the discharge product and reduce the influence of the titanium oxide particles on image quality by using both the amorphous silicon photoconductor drum having a heater provided therein and the rotating member that polishes the surface of the amorphous silicon photoconductor drum using the titanium oxide particles, and performing a temperature control process using the heater and a cleaning process using the rotating member under predetermined conditions.

Therefore, it is possible to effectively use the non-contact type charging device while suppressing the adhesion of a discharge product to the surface of the photosensitive layer.

When the non-contact type charging device is used, the non-contact type charging device does not involve a physical motion, such as rotation or slide friction, unlike the contact type charging device, and the non-contact type charging is not contaminated by toner. Therefore, the non-contact type changing device performs stable charging continuously.

Second Embodiment

A second embodiment provides an image forming method including: developing and transferring electrostatic latent images formed on an amorphous silicon photoconductor drum having a heater provided therein; and cleaning the surfaces of the amorphous silicon photoconductor drum using a rotating member and titanium oxide particles included in toner particles, after the images are transferred. In the method, the heater is controlled such that the surface temperature of the amorphous silicon photoconductor drum is higher by 4° C. or more than the outdoor temperature, which is in a range of 10 to 40° C. In addition, slide friction between the amorphous silicon photoconductor drum and the rotating member is set in a range of 40 to 900 g/cm, and the average primary particle diameter of the titanium oxide particles is set in a range of 0.005 to 0.25 μm.

Hereinafter, an image forming method according to the second embodiment will be described in detail. In this embodiment, a description of the same content as that in the first embodiment will be omitted.

1. Basic Process

First, the image carriers (amorphous silicon photoconductor drums) 13M to 13BK of the image forming apparatus 10 shown in FIG. 1 are rotated at a predetermined process speed (peripheral speed) in the direction of an arrow, and the surfaces thereof are charged with a predetermined potential by the charging devices 14M to 14BK.

Then, the exposure devices 15M to 15BK expose the surfaces of the image carriers 13M to 13BK with light that is modulated according to image information using, for example, a reflecting mirror. The exposure causes color electrostatic latent images to be formed on the surfaces of the image carriers 13M to 13BK.

In the present invention, since the amorphous silicon photoconductor drums, serving as the image carriers 13M to 13BK, have heaters provided therein, it is possible to suppress the electrostatic latent images from being deleted due to water absorbed on the surface of the photosensitive layer.

Then, the developing units 11M to 11BK perform latent image developing based on the electrostatic latent images. The developing devices 11M to 11BK have color (black, cyan, magenta, and yellow) developers accommodated therein, and the developers are adhered to the electrostatic latent images on the surfaces of the image carriers 13M to 13BK, thereby forming developer images on the recording materials.

The recording sheet is transported up to the lower part of the image carriers 13M to 13BK in a predetermined transfer and transport path. In this case, a predetermined transfer bias voltage is applied between the image carriers 13M to 13BK and the transfer devices 16M to 16BK to transfer the developer images.

Then, the recording sheet having the developer images transferred thereto is separated from the surfaces of the image carriers 13M to 13BK by a separating unit (not shown), and is then transported to the fixing device 20 by the transport belt 15. Then, the fixing device 20 performs heating and pressurizing processes on the recording sheet to fix the developer images on the surface of the recording sheet, and the recording sheet is discharged to the outside of the image forming apparatus 10 by a discharge roller.

Meanwhile, after transferring the developer images, the image carriers 13M to 13BK are continuously rotated, a non-transferred developer remaining on the surfaces of the image carrier 13M to 13BK is removed by the cleaning blades 22M to 22BK of the cleaning devices 23M to 23BK. The removed non-transferred developer is stored in slide friction portions between the amorphous silicon photoconductor drums, serving as the image carriers 13M to 13BK, and the rotating members 21M to 21BK of the cleaning devices 23M to 23BK. Therefore, it is possible to effectively remove the discharge product adhered to the surfaces of the amorphous silicon photoconductor drums using the titanium oxide particles included in the developers.

In addition, charge remaining on the surfaces of the image carriers 13M to 13BK may be removed by radiation of charge elimination light emitted from a charge eliminating unit (not shown).

According to the present invention, it is possible to effectively suppress the occurrence of image deletion and stably suppress the occurrence of color muddiness due to the influence of titanium oxide particles by using both the amorphous silicon photoconductor drum having a heater provided therein and the rotating member that polishes the surface of the amorphous silicon photoconductor drum using the titanium oxide particles, and performing a temperature control process using the heater and a cleaning process using the rotating member under predetermined conditions.

2. Developer

In the present invention, a magnetic or non-magnetic single-component developer or a two-component developer, which is a mixture of a magnetic carrier and a non-magnetic developer, may be used as the developer.

In addition, the average particle diameter of toner particles forming the developer is not particularly limited, but it is preferably in a range of, for example, 4 to 15 μm.

The reason is as follows. When the average particle diameter of the toner particles is smaller than 4 μm, the cleaning efficiency of the remaining toner is likely to be lowered. On the other hand, when the average particle diameter of the toner particles is larger than 15 μm, it may be difficult to obtain a high-quality image.

Therefore, the average particle diameter of the toner particles forming the developer is preferably in a range of 5 to 11 μm, more preferably, in a range of 5 to 10 μm.

(1) Binder Resin

As the binder resin used for the toner particles, a thermoplastic resin, such as styrene resin, acrylic resin, styrene-acrylic copolymer, polyethylene resin, polypropylene resin, vinyl chloride resin, polyester resin, polyamide resin, polyurethane resin, polyvinyl alcohol resin, vinyl ether resin, N-vinyl resin, or styrene-butadiene resin, may be used, but the present invention is not limited thereto.

(2) Wax

It is preferable to add wax to the toner particles, in order to obtain the effect of a fixing property or an offset property.

For example, one kind of was, such as polyethylene wax, polypropylene wax, fluororesin wax, Fischer Tropsch wax, paraffin wax, ester wax, montan wax, or rice wax, or a combination of two or more kinds of wax may be used, but the present invention is not limited thereto.

(3) Charge Control Agent

Further, it is preferable to add a charge control agent to the toner particles, in order to remarkably improve a charge level or a charge rise characteristic (an index indicating whether to perform charging at a predetermined charge level in a short time), and obtain high durability and stability.

For example, a positive charge control agent, such as nigrosine, quaternary ammonium salt chemical compound, or a resin-type charge control agent obtained by binding an amine compound to resin, may be used as the charge control agent, but the present invention is not limited thereto.

(4) Magnetic Powder and Carrier

Furthermore, a known magnetic powder or carrier may be added to the developer.

For example, any of the following materials may be used as the magnetic powder or the carrier: ferromagnetic metal, such as ferrite, magnetite, iron, cobalt, or nickel or alloys thereof; compounds including these ferromagnetic elements; and alloys that do not contain the ferromagnetic elements but show ferromagnetism by appropriate heat treatment.

(5) Additive

As described in the first embodiment, the second embodiment is characterized in that titanium oxide particles having an average primary particle diameter of 0.005 to 0.25 μm are used as an additive that is added to the toner particles.

It is preferable that 0.1 to 5 parts by weight of titanium oxide particles be added with respect to 100 parts by weight of toner particles.

The reason is as follows. When the amount of titanium oxide particles added is set in the above-mentioned range, it is possible to more effectively remove the discharge product adhered to the surface of the photosensitive layer, and stably suppress the occurrence of color muddiness in a formed image.

That is, when the content of the titanium oxide particles added is less than 0.1 parts by weight, the effect of removing the discharge product adhered to the surface of the photosensitive layer is significantly deteriorated, and thus it may be difficult to suppress the occurrence of image deletion. On the other hand, when the content of the titanium oxide particles added is above 5 parts by weight, it may be difficult to stably suppress the occurrence of color muddiness in a formed image.

Therefore, the amount of titanium oxide particles added is preferably in a range of 0.2 to 4 parts by weight, more preferably, 0.2 to 3 parts by weight with respect to 100 parts by weight of toner particles.

The titanium oxide may be exteriorly added to the toner particles, or it may be compounded into the toner particles.

Furthermore, it is preferable to exteriorly add silica particles to the toner particles.

The average particle diameter of the silica particles is preferably in a range of 0.002 to 0.1 μm, more preferably, 0.007 to 0.06 μm.

The amount of titanium oxide particles added is preferably in a range of 0.1 to 5 parts by weight, more preferably, 0.4 to 4 parts by weight with respect to 100 parts by weight of toner particles.

EXAMPLES

Hereinafter, the present invention will be described in detail using Examples, but is not limited thereto.

Example 1

1. Preparation of Developer (1) Production of Magenta Toner Particles

First, magnetic powder was mixed with a binder resin including a plurality of polyester resin, and the mixture was melted and kneaded.

More specifically, 100 parts by weight of polyester resin (alcohol component: bisphenol A-propion oxide compound, acid component: terephthalic acid, Tg: 60° C., softening point: 150° C., acid value: 7.0, and gel fraction: 30%), 3 parts by weight of quaternary ammonium salt (FCA201PS produced by FUJIKURA KASEI CO., LTD.), serving as a charge control agent, 5 parts by weight of ester wax, (brand name: WEP•5 produced by NOF CORPORATION), serving as a wax component, and 4 parts by weight of quinacridone pigment (C.I. Pigment Red 122) were mixed with each other by a Henschel mixer.

Then, the mixture was kneaded by a two screw extruder (cylinder setting temperature: 100° C.), and then roughly grinded by a feather mill. Then, the particles were finely grinded by a turbo mill, and then classified by an airflow type classifier, thereby obtaining magenta toner particles having an average particle diameter of 8.0 μm.

(2) Production of Cyan Toner Particles

Cyan toner particles having an average particle diameter of 8.0 μm were produced by the same method as that produces the magenta toner particles except that phthalocyanine pigment (C.I. Pigment Blue 15:1) was used as a coloring agent, instead of the quinacridone pigment (C.I. Pigment Red 122).

(3) Production of Yellow Toner Particles

Yellow toner particles having an average particle diameter of 8.0 μm were produced by the same method as that produces the magenta toner particles except that azo pigment (C.I. Pigment Yellow 180) was used as a coloring agent, instead of the quinacridone pigment (C.I. Pigment Red 122).

(4) Production of Black Toner Particles

Black toner particles having an average particle diameter of 8.0 μm were produced by the same method as that produces the magenta toner particles except that carbon black (MA100 produced by MITSUBISHI CHEMICAL CORPORATION) was used as a coloring agent, instead of the quinacridone pigment (C.I. Pigment Red 122).

(3) Addition of Additive

Then, 0.8 parts by weight of silica particles (RA200HS produced by NIPPON AEROSIL CO., LTD.) and 1.0 part by weight of titanium oxide having an average primary particle diameter of 0.2 μm were mixed with respect to 100 parts by weight of toner particles of each color by the Henschel mixer to obtain added toner particles of each color.

(2) Mixture with Carrier

Then, 8 wt % of added toner particles of each color were compounded into a ferrite carrier (which has a diameter of 45 μm and is produced by POWDERTECH CO., LTD.), and they were mixed with each other by a ball mill for 30 minutes, thereby obtaining a two-component color developer.

2. Image Formation

Then, the color image forming apparatus including the obtained developer, shown in FIG. 1, was used to print out 300,000 images having a printing density of 6% under the following image forming conditions.

(1) Outdoor Conditions of the Image Forming Apparatus

Outdoor conditions of the image forming apparatus which is provided in the room were measured as the room conditions.

Temperature: 28° C.

Humidity: 80% RH (2) Charging Conditions

Charging device: scorotron

DC bias: 6.0 kV (3) Photoconductor Drums Conditions

Surface temperature: 33° C. (controlled by a built-in heater)

Document: 6% document for each color

Photoconductor: amorphous silicon photoconductor drum (thickness is 15 μm)

Drum peripheral speed: 150 mm/s

Printing speed: 32 sheets/minute

Surface voltage: 270 V (4) Transfer Conditions

Primary transfer current: 16 μA

Secondary transfer current: 30 μA (5) Rotating Member Conditions

Material forming the elastic layer: EPDM

Thickness of the elastic layer: 1.5 mm

Average cell diameter of foam cells in the elastic layer: 150 μm

Asker C hardness of the elastic layer: 58

Slide friction: 800 g/cm

The ratio of the peripheral speed of the rotating member and the peripheral speed of the drum: 1.2 times (the rotation of the rotating member in a trail direction relative to the drum)

(6) Cleaning Blade Conditions

Blade hardness: 70° (JIS-A standard)

Material: urethane

Thickness: 2.2 mm

Protruding length: 11 mm

Linear pressure: 22 g/cm

Pressure contact angle: 25°

3. Evaluation (1) Evaluation of Occurrence of Color Muddiness

The occurrence of color muddiness in a formed image was evaluated.

That is, after 300,000 images were printed, 100 image patterns having black and color solid patches (a square of 2 cm×2 cm) formed thereon were printed under the same conditions as described above, the occurrence of color muddiness in the image patterns were examined by a microscope and then evaluated according to the following standards:

Good: no color muddiness occurs in the 100 color and black images;

Fair: a little color muddiness occurs in the 100 color or black images; and

Bad: color muddiness certainly occurs in the 100 color or black images.

The obtained results are shown in Table 1.

(2) Evaluation of Generation of Jitter

The generation of jitter in a formed image was evaluated.

That is, after 300,000 images were printed, 100 gray images were printed, and the generation of jitter from the 100 gray images was examined by eyes and then evaluated according to the following standards:

Good: no jitter is generated from the 100 gray images;

Fair: a little jitter is generated from the 100 gray images; and

Bad: jitter is certainly generated from the 100 gray images.

The obtained results are shown in Table 1.

(3) Evaluation of Occurrence of Image Deletion

The generation of image deletion in a formed image was evaluated.

That is, after 300,000 images were printed, the image forming apparatus was left as it is while maintaining the temperature and humidity for 8 hours.

Then, a text image was printed, and the occurrence of image deletion in the first image was examined by eyes and then evaluated according to the following standards:

Good: no image deletion occurs;

Fair: a little image deletion occurs; and

Bad: image deletion certainly occurs.

The obtained results are shown in Table 1.

Example 2

In Example 2, an image forming process was performed under the same conditions as those in Example 1 except that the slide friction of the rotating member was set to 400 g/cm, and the formed image was evaluated. The obtained results are shown in Table 1.

Example 3

In Example 3, an image forming process was performed under the same conditions as those in Example 1 except that the slide friction of the rotating member was set to 50 g/cm, and the formed image was evaluated. The obtained results are shown in Table 1.

Example 4

In Example 4, an image forming process was performed under the same conditions as those in Example 1 except that, when a developer was prepared, the average primary particle diameter of the titanium oxide particles was set to 0.15 μm and the slide friction of the rotating member was set to 50 g/cm, and the formed image was evaluated. The obtained results are shown in Table 1.

Example 5

In Example 5, an image forming process was performed under the same conditions as those in Example 1 except that, when a developer was prepared, the average primary particle diameter of the titanium oxide particles was set to 0.01 μm and the slide friction of the rotating member was set to 50 g/cm, and the formed image was evaluated. The obtained results are shown in Table 1.

Example 6

In Example 6, an image forming process was performed under the same conditions as those in Example 1 except that, when a developer was prepared, the average primary particle diameter of the titanium oxide particles was set to 0.05 μm and the slide friction of the rotating member was set to 50 g/cm, and the formed image was evaluated. The obtained results are shown in Table 1.

Example 7

In Example 7, an image forming process was performed under the same conditions as those in Example 1 except that, when a developer was prepared, the average primary particle diameter of the titanium oxide particles was set to 0.01 μm, the outdoor temperature was set to 32° C., the surface temperature of the amorphous silicon photoconductor drum was set to 37° C., and the slide friction of the rotating member was set to 50 g/cm, and the formed image was evaluated. The obtained results are shown in Table 1.

Example 8

In Example 8, an image forming process was performed under the same conditions as those in Example 1 except that, when a developer was prepared, the average primary particle diameter of the titanium oxide particles was set to 0.01 μm, the outdoor temperature was set to 32° C., the surface temperature of the amorphous silicon photoconductor drum was set to 42° C., and the slide friction of the rotating member was set to 50 g/cm, and the formed image was evaluated. The obtained results are shown in Table 1.

Comparative Example 1

In Comparative example 1, an image forming process was performed under the same conditions as those in Example 1 except that, when a developer was prepared, the average primary particle diameter of the titanium oxide particles was set to 0.4 μm, the surface temperature of the amorphous silicon photoconductor drum was not controlled by the heater, and the slide friction of the rotating member was set to 1000 g/cm, and the formed image was evaluated. The obtained results are shown in Table 1.

Comparative Example 2

In Comparative example 2, an image forming process was performed under the same conditions as those in Example 1 except that, when a developer was prepared, the average primary particle diameter of the titanium oxide particles was set to 0.3 μm, the surface temperature of the amorphous silicon photoconductor drum was not controlled by the heater, and the slide friction of the rotating member was set to 1000 g/cm, and the formed image was evaluated. The obtained results are shown in Table 1.

Comparative Example 3

In Comparative example 3, an image forming process was performed under the same conditions as those in Example 1 except that the surface temperature of the amorphous silicon photoconductor drum was not controlled by the heater and the slide friction of the rotating member was set to 1000 g/cm, and the formed image was evaluated. The obtained results are shown in Table 1.

Comparative Example 4

In Comparative example 4, an image forming process was performed under the same conditions as those in Example 1 except that the slide friction of the rotating member was set to 1000 g/cm, and the formed image was evaluated. The obtained results are shown in Table 1.

Comparative Example 5

In Comparative example 5, an image forming process was performed under the same conditions as those in Example 1 except that, when a developer was prepared, the average primary particle diameter of the titanium oxide particles was set to 0.01 μm, the outdoor temperature was set to 32° C., the surface temperature of the amorphous silicon photoconductor drum was set to 35° C., and the slide friction of the rotating member was set to 50 g/cm, and the formed image was evaluated. The obtained results are shown in Table 1.

Comparative Example 6

In Comparative example 6, an image forming process was performed under the same conditions as those in Example 1 except that, when a developer was prepared, the average primary particle diameter of the titanium oxide particles was set to 0.01 μm, the outdoor temperature was set to 32° C., the surface temperature of the amorphous silicon photoconductor drum was set to 33° C., and the slide friction of the rotating member was set to 50 g/cm, and the formed image was evaluated. The obtained results are shown in Table 1.

Comparative Example 7

In Comparative example 7, an image forming process was performed under the same conditions as those in Example 1 except that, when a developer was prepared, the average primary particle diameter of the titanium oxide particles was set to 0.3 μm and the slide friction of the rotating member was set to 50 g/cm, and the formed image was evaluated. The obtained results are shown in Table 1.

Comparative Example 8

In Comparative example 8, an image forming process was performed under the same conditions as those in Example 1 except that, when a developer was prepared, the average primary particle diameter of the titanium oxide particles was set to 0.4 μm and the slide friction of the rotating member was set to 50 g/cm, and the formed image was evaluated. The obtained results are shown in Table 1.

Comparative Example 9

In Comparative example 9, an image forming process was performed under the same conditions as those in Example 1 except that the slide friction of the rotating member was set to 20 g/cm, and the formed image was evaluated. The obtained results are shown in Table 1.

Comparative Example 10

In Comparative example 10, an image forming process was performed under the same conditions as those in Example 1 except that the surface temperature of the amorphous silicon photoconductor drum was not controlled by the heater and the slide friction of the rotating member was set to 50 g/cm, and the formed image was evaluated. The obtained results are shown in Table 1.

Comparative Example 11

In Comparative example 11, an image forming process was performed under the same conditions as those in Example 1 except that, when a developer was prepared, the titanium oxide was not used, and the slide friction of the rotating member was set to 50 g/cm, and the formed image was evaluated. The obtained results are shown in Table 1.

TABLE 1

| | Number average particle diameter of titanium oxide particles (μm) | Slide friction of rotating member (g/cm) | Temperature control | | | | Evaluation | | |
|---|---|---|---|---|---|---|---|---|---|
| | | | Use of heater | Surface temperature of drum (° C.) | Outdoor temperature (° C.) | Temperature difference (° C.) | Occurrence of color muddiness | Jitter | Image delection |
| Example 1 | 0.2 | 800 | Good | 33 | 28 | 5 | Good | Good | Good |
| Example 2 | 0.2 | 400 | Good | 33 | 28 | 5 | Good | Good | Good |
| Example 3 | 0.2 | 50 | Good | 33 | 28 | 5 | Good | Good | Good |
| Example 4 | 0.15 | 50 | Good | 33 | 28 | 5 | Good | Good | Good |
| Example 5 | 0.01 | 50 | Good | 33 | 28 | 5 | Good | Good | Good |
| Example 6 | 0.05 | 50 | Good | 33 | 28 | 5 | Good | Good | Good |
| Example 7 | 0.01 | 50 | Good | 37 | 32 | 5 | Good | Good | Good |
| Example 8 | 0.01 | 50 | Good | 42 | 32 | 10 | Good | Good | Good |
| Comparative example 1 | 0.4 | 1000 | Bad | 28 | 28 | 0 | Bad | Fair | Good |
| Comparative example 2 | 0.3 | 1000 | Bad | 28 | 28 | 0 | Fair | Fair | Good |
| Comparative example 3 | 0.2 | 1000 | Bad | 28 | 28 | 0 | Good | Fair | Fair |
| Comparative example 4 | 0.2 | 1000 | Good | 33 | 28 | 5 | Good | Fair | Good |
| Comparative example 5 | 0.01 | 50 | Good | 35 | 32 | 3 | Good | Good | Fair |

TABLE 1-continued

| | Number average particle diameter of titanium oxide particles (μm) | Slide friction of rotating member (g/cm) | Temperature control: Use of heater | Temperature control: Surface temperature of drum (° C.) | Temperature control: Outdoor temperature (° C.) | Temperature control: Temperature difference (° C.) | Evaluation: Occurrence of color muddiness | Evaluation: Jitter | Evaluation: Image delection |
|---|---|---|---|---|---|---|---|---|---|
| Comparative example 6 | 0.01 | 50 | Good | 33 | 32 | 1 | Good | Good | Bad |
| Comparative example 7 | 0.3 | 50 | Good | 33 | 28 | 5 | Fair | Good | Good |
| Comparative example 8 | 0.4 | 50 | Good | 33 | 28 | 5 | Bad | Good | Good |
| Comparative example 9 | 0.2 | 20 | Good | 33 | 28 | 5 | Good | Good | Bad |
| Comparative example 10 | 0.2 | 50 | Bad | 28 | 28 | 0 | Good | Good | Bad |
| Comparative example 11 | — | 50 | Good | 33 | 28 | 5 | Good | Good | Bad |

INDUSTRIAL APPLICABILITY

According to the image forming apparatus and the image forming method of the present invention, it is possible to effectively remove a discharge product adhered to the surface of the photosensitive layer and water absorbed by the discharge product and stably suppress the deterioration of image quality due to the titanium oxide particles by using both the amorphous silicon photoconductor drum having a heater provided therein and the rotating member that polishes the surface of the amorphous silicon photoconductor drum using the titanium oxide particles, and setting the difference between the surface temperature of the amorphous silicon photoconductor drum and the outdoor temperature, the slide friction between the amorphous silicon photoconductor drum and the rotating member, and the average primary particle diameter of the titanium oxide particles in predetermined ranges.

As a result, it is possible to effectively suppress the occurrence of image deletion and color muddiness, and thus stably obtain a high-quality image.

Therefore, it is expected that the image forming apparatus and the image forming method according to the present invention will contribute to increasing the life span of a color printer and improving the performance thereof.

What is claimed is:

1. An image forming apparatus comprising:

an amorphous silicon photoconductor drum having a heater provided therein;

a charging device; and a rotating member that cleans the surfaces of the amorphous silicon photoconductor drum using titanium oxide particles included in toner particles, wherein the heater is controlled such that the surface temperature of the amorphous silicon photoconductor drum is higher by 4° C. or more than the outdoor temperature, which is in a range of 10 to 40° C., slide friction between the amorphous silicon photoconductor drum and the rotating member is set in a range of 40 to 900 gf/cm, and the average primary particle diameter of the titanium oxide particles is set in a range of 0.005 to 0.25 μm.

2. The image forming apparatus according to claim 1, wherein 0.1 to 5 parts by weight of titanium oxide particles are added with respect to 100 parts by weight of toner particles.

3. The image forming apparatus according to claim 1, wherein the rotating member has an elastic layer in its outer circumferential portion.

4. The image forming apparatus according to claim 3, wherein the rotating member having the elastic layer is a foam sponge roller.

5. The image forming apparatus according to claim 1, wherein the charging device is a non-contact type.

6. The image forming apparatus according to claim 1, wherein the image forming apparatus is a color image forming apparatus.

7. An image forming method comprising:

developing and transferring electrostatic latent images formed on an amorphous silicon photoconductor drum having a heater provided therein; and cleaning the surfaces of the amorphous silicon photoconductor drum using a rotating member and titanium oxide particles included in toner particles, after the images are transferred;

wherein the heater is controlled such that the surface temperature of the amorphous silicon photoconductor drum is higher by 4° C. or more than the outdoor temperature, which is in a range of 10 to 40° C., slide friction between the amorphous silicon photoconductor drum and the rotating member is set in a range of 40 to 900 gf/cm, and the average primary particle diameter of the titanium oxide particles is set in a range of 0.005 to 0.25 μm.

* * * * *